US008209972B2

(12) United States Patent
Tüch

(10) Patent No.: US 8,209,972 B2
(45) Date of Patent: Jul. 3, 2012

(54) X-TUBE AND CORRESPONDING EXHAUST SYSTEM

(75) Inventor: Markus Tüch, Bad Überkingen (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 286 days.

(21) Appl. No.: 12/635,075

(22) Filed: Dec. 10, 2009

(65) Prior Publication Data

US 2010/0146955 A1 Jun. 17, 2010

(30) Foreign Application Priority Data

Dec. 11, 2008 (DE) ..... 10 2008 061 829

(51) Int. Cl.
*F01N 1/00* (2006.01)

(52) U.S. Cl. ..... 60/323; 60/272; 60/305; 60/312; 60/322; 60/324

(58) Field of Classification Search ..... 60/272, 60/305, 312, 313, 314, 322, 323, 324
See application file for complete search history.

(56) References Cited

U.S. PATENT DOCUMENTS 3,072,214 A 1/1963 Deremer
4,926,634 A * 5/1990 Putz et al. ..... 60/274
5,018,349 A * 5/1991 Pemberton ..... 60/313
5,144,799 A * 9/1992 Barth ..... 60/313
5,740,671 A 4/1998 Jones
6,247,305 B1 * 6/2001 Bassani ..... 60/312
7,596,944 B2 * 10/2009 Mueller et al. ..... 60/323
7,856,815 B2 * 12/2010 Demura et al. ..... 60/324

FOREIGN PATENT DOCUMENTS

DE 103 54 699 A1 6/2005
EP 1 767 757 A2 3/2007

* cited by examiner

*Primary Examiner* — Binh Q Tran
(74) *Attorney, Agent, or Firm* — McGlew and Tuttle, P.C.

(57) ABSTRACT

An X-tube (1) is provided, for an at least partly double-flow exhaust system (2) of an internal combustion engine, especially of a motor vehicle, with a housing (3), which comprises two half shells (4, 5) and which has two inlet openings (7, 8) on an inlet side (6) and two outlet openings (10, 11) on an outlet side (9). The housing provides an interior space (12), which is enclosed by the housing (3) and to which the openings (7, 8, 10, 11) are connected in a communicating manner, with a bottom—partition (13), which is designed as a separate component in relation to the two half shells (4, 5) and which divides the interior space (12) into two ducts (14, 15), which are each connected to an inlet opening (7, 8) and to an outlet opening (10, 11) in a communicating manner. The bottom (13) is made permeable for airborne sound and connects the two ducts (14, 15) to one another in an airborne sound-transmitting manner.

20 Claims, 4 Drawing Sheets

X-TUBE AND CORRESPONDING EXHAUST SYSTEM

CROSS REFERENCE TO RELATED APPLICATIONS

This application claims the benefit of priority under 35 U.S.C. §119 of German Patent Application DE 10 2008 061 829.2 filed Dec. 11, 2008, the entire contents of which are incorporated herein by reference.

FIELD OF THE INVENTION

The present invention pertains to an X-tube for an at least partially double-flow exhaust system of an internal combustion engine, especially of a motor vehicle. The present invention pertains, in addition, to an exhaust system for an internal combustion engine, especially of a motor vehicle, which exhaust system is equipped with such an X-tube.

BACKGROUND OF THE INVENTION

X-tubes, which may also be called X-hoses, are used in exhaust systems, which are designed as double-flow exhaust systems at least in some areas, to couple the two exhaust pipes of the double-flow section, through which exhaust gas can flow in parallel, with one another. This coupling shall make possible a pressure equalization and especially a sound pressure equalization between the two exhaust pipes, so that an exchange of airborne sound takes place between the two exhaust pipes.

Such an X-tube correspondingly comprises a housing, which has two inlet openings on an inlet side for two arriving sections of the two exhaust pipes and two outlet openings for two exiting sections of the two exhaust pipes on an outlet side. The desired pressure equalization or the desired sound transmission will then take place in an interior space, which is enclosed by the housing and with which the openings are connected in a communicating manner.

It is necessary not to increase the flow resistance of the exhaust system substantially by the use of such an X-tube. Furthermore, it is desirable to have the ability to manufacture such an X-tube at the lowest cost possible.

SUMMARY OF THE INVENTION

The object of the present invention is to propose an improved embodiment for an X-tube or for an exhaust system equipped therewith, which embodiment is characterized in that the X-tube has a comparatively low flow resistance and can be manufactured at a low cost.

According to the invention, an X-tube is provided for an at least partly double-flow exhaust system of a motor vehicle internal combustion engine. The X-tube comprises a housing comprising two half shells providing two inlet openings on an inlet side and two outlet openings on an outlet side. An interior space is enclosed by the housing and the openings are connected to the interior space in a communicating manner. A bottom (partition member), comprising a separate component in relation to the two half shells, divides the interior space into two ducts. The two ducts are each connected to a respective one of the inlet openings and to a respective one of the outlet openings, each in a communicating manner. The bottom is made permeable to airborne sound and connects the two ducts to one another in an airborne sound-transmitting manner.

The present invention is based on the general idea of manufacturing the housing from two half shells and of arranging in the interior space a bottom, which is permeable to airborne sound and which divides the interior space into two ducts, through which flow can take place in parallel. The two ducts, through which flow is possible in a separated manner, can communicate with one another in terms of pressure transmission as well as concerning airborne sound transmission through the bottom. Exchange of gas is also possible, in principle. The ducting of the interior space by means of the bottom reduces the flow resistance of the X-tube. However, what is especially advantageous here is the circumstance that only three components are, in principle, necessary for embodying the X-tube being presented here, namely, the two half shells and the bottom. The manufacture of the X-tube becomes extremely inexpensive as a result.

Especially advantageous is an embodiment in which the half shells have, between the ducts, a mounting groove each, into which the bottom is inserted with its longitudinal ends. Positive-locking fixation or positioning of the bottom in the half shells is achieved hereby.

According to a variant, the half shells may have between the ducts two inwardly projecting longitudinal beads each, which extend in parallel to one another and which form the respective mounting groove. The mounting grooves can be manufactured at an especially low cost due to this mode of construction. At the same time, the beads lead to stiffening of the half shells in the area of the bottom.

Corresponding to an advantageous embodiment, the bottom may have a collar, which extends circumferentially on the edge and projects from the duct, on a side facing one of the ducts. The bottom is intensively stiffened hereby, which improves the supporting of the two half shells on one another via the bottom, on the one hand, and stiffens the housing in the area of the bottom, on the other hand.

Especially advantageous is a variant in which the collar is flattened on the inlet side, i.e., on the incoming flow side, and on the outlet side, i.e., on the discharge side. Noise generation can be prevented by this flattening in the X-tube, especially during the start of an internal combustion engine, whose exhaust system is equipped with such an X-tube.

According to another advantageous embodiment, the two half shells may be designed as identical parts. This means that the two half shells are identical. This mode of construction causes that only two different components, namely, the two identical half shells and the one bottom, must be ultimately used to manufacture the X-tube. The manufacturing costs can be reduced even more hereby.

Other important features and advantages of the present invention appear from the subclaims, from the drawings and from the corresponding description of the figures on the basis of the drawings.

It is apparent that the above-mentioned features, which will also be explained below, can be used not only in the particular combination described, but in other combinations or alone as well without going beyond the scope of the present invention.

Preferred exemplary embodiments of the present invention are shown in the drawings and will be explained in more detail in the following description, where identical reference numbers designate identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 8:
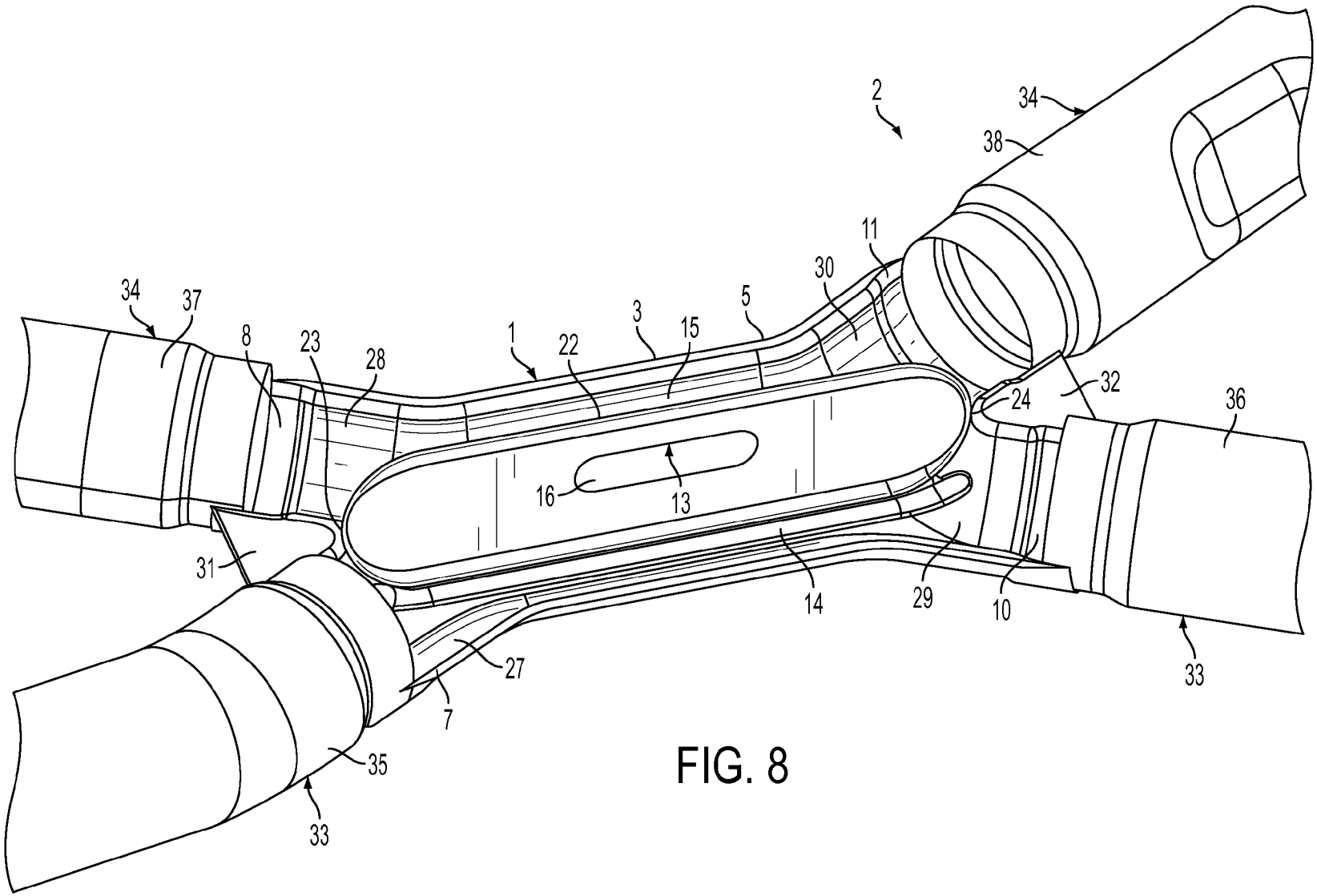
FIG. 8 is a perspective view of an exhaust system in the area of an X-tube with a half shell omitted.

Referring to the drawings in particular, corresponding to FIGS. 1 through 8, an X-tube 1, which may be used corresponding to FIG. 8 in an at least partially double-flow exhaust system 2, comprises a housing 3, which is assembled from two half shells 4, 5. The two half shells 4, 5 may be designed as identical parts according to an advantageous embodiment. The two half shells 4, 5 are now identical. Housing 3 has two inlet openings, namely, a first inlet opening 7 and a second inlet opening 8, on an inlet side 6. On an outlet side 9 located away from the inlet side 6, housing 3 has two outlet openings, namely, a first outlet opening 10 and a second outlet opening 11.

Housing 3 encloses an interior space 12, which is connected in a communicating manner with the openings 7, 8, 10, 11. A bottom 13 is arranged in the interior space 12. This [bottom] forms a separate component in relation to the two half shells 4, 5. It divides the interior space 12 into two ducts, namely, a first duct 14 and a second duct 15. The division of the interior space 12 into the two ducts 14, 15 is carried out such that each duct 14, 15 is connected to an inlet opening 7, 8 and to an outlet opening 10, 11 in a communicating manner. In the example, the first duct 14 is connected to the first inlet opening 7 and to the first outlet duct 10 in a communicating manner, while the second duct 15 is connected to the second inlet opening 8 and to the second outlet opening 11 in a communicating manner.

Bottom 13 is made permeable to airborne sound. It connects the two ducts 14, 15 in terms of airborne sound transmission. In the example being shown, bottom 13 contains a passage opening 16, through which the two ducts 14, 15 are connected to one another in a communicating manner. Passage opening 16 is merely an example here. Even though it is a preferred embodiment, it may, in principle, also be formed by a perforation. Clamp-like openings are likewise conceivable, which are opened and closed against the direction of flow and reduce, for example, flow noises. Bottom 13 may also be provided with a slot aerodynamically optimized in respect to flow noises and flow resistance.

Corresponding to the preferred embodiment being shown here, the two half shells 4, 5 have a mounting groove 17 each. The two mounting grooves 17 are located opposite each other in the interior space 12 and together form a mount, into which bottom 13 is inserted with its longitudinal ends. To form the mounting grooves 17, the half shells 4, 5 may have two longitudinal beads 19, which project inwardly and extend in parallel to one another, on their outer sides. The two longitudinal beads 19 extend at spaced locations from one another in the interior space 12, so that they form the respective mounting groove 17 between them. The longitudinal beads 19 form an intensive stiffening of the respective half shell 4, 5 in the area of bottom 13.

Bottom 13 is fixed in its position in housing 3. This fixation of the position may be embodied by a bracing with the half shells 4, 5. The position is then fixed exclusively by frictional connection or frictional engagement. As an alternative or in addition, a welded connection or a soldered connection of the bottom 13 to at least one of the half shells 4, 5 may be provided as well in order to fix the position of bottom 13 in housing 3. For example, the bracing of bottom 13 may be embodied when the two half shells 4, 5 are connected to one another. For example, the two half shells 4, 5 are welded together along flanged webs 20 projecting outwardly. When preparing these welded connections, bottom 13 may also be welded to the respective half shell 4, 5 from the outside through the respective half shell 4, 5.

Bottom 13 is made flat in the embodiment being shown here, so that it extends in one plane. The plane of bottom 13 extends in parallel to the two ducts 14, 15. The two ducts 14, 15 extend, in turn, in parallel to one another and each in parallel to a principal direction of flow 21 prevailing in the respective duct 14, 15, which is indicated by arrows in FIG. 2.

Furthermore, the plane of bottom 13 extends at right angles to a plane of separation, in which the two half shells 4, 5 are attached to one another. This plane of separation may form, in particular, a plane of symmetry for the two half shells 4, 5. Moreover, the plane of separation of the half shells 4, 5 may also form a plane of symmetry for bottom 13 if it is shaped mirror-symmetrical in relation to this plane of separation corresponding to the embodiment being shown here.

Figure 1:
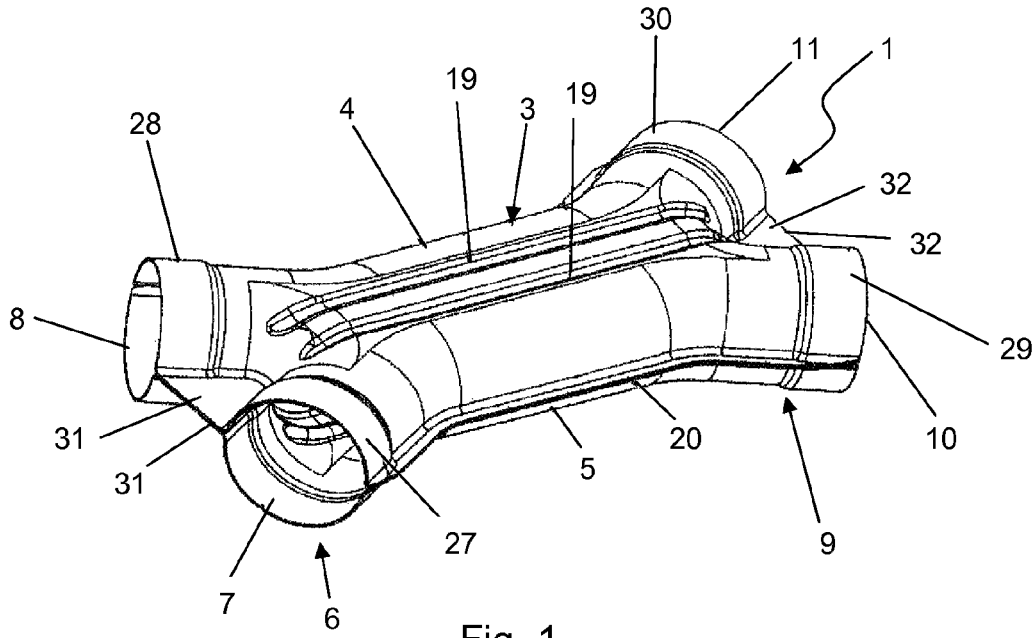
FIG. 1 is a perspective view of an X-tube according to the invention.
Figure 2:
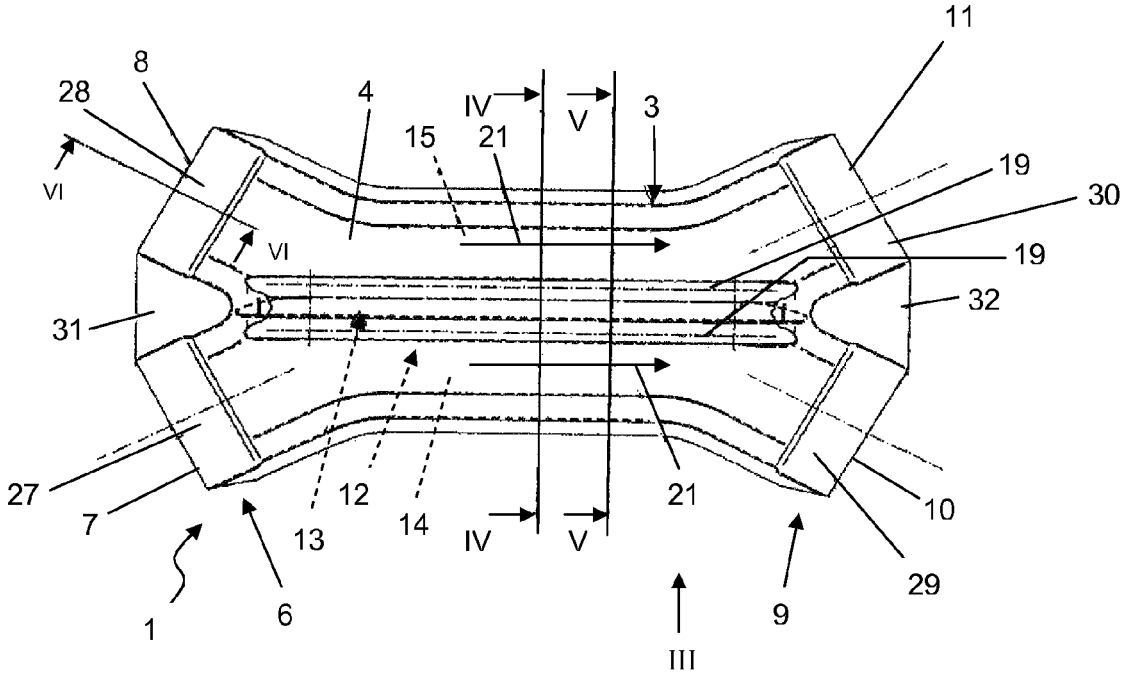
FIG. 2 is a partly transparent top view of the X-tube.
Figure 3:
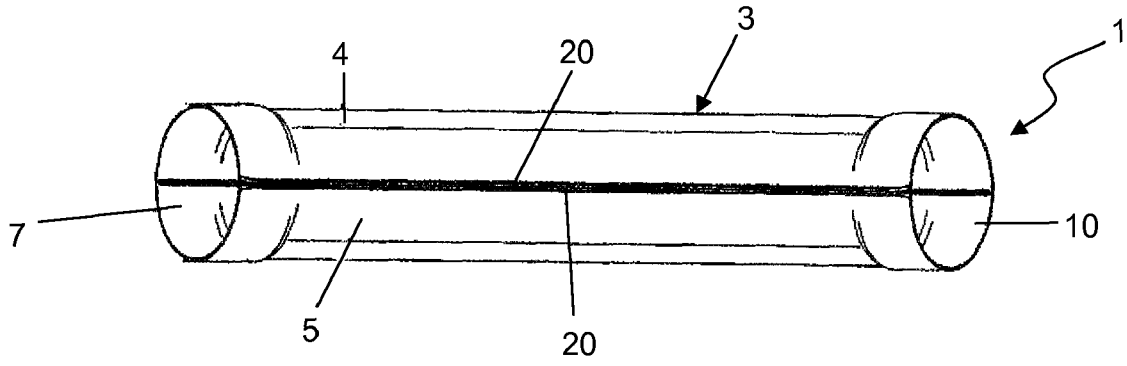
FIG. 3 is a side view of the X-tube corresponding to a direction of view III in FIG. 2.
Figure 4:
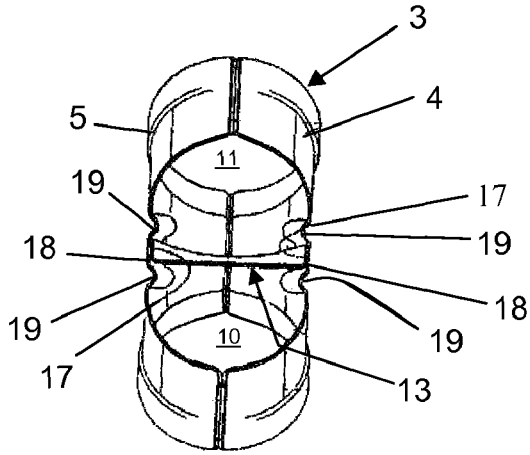
FIG. 4 is a sectional view of the X-tube corresponding to section lines IV in FIG. 2.
Figure 5:
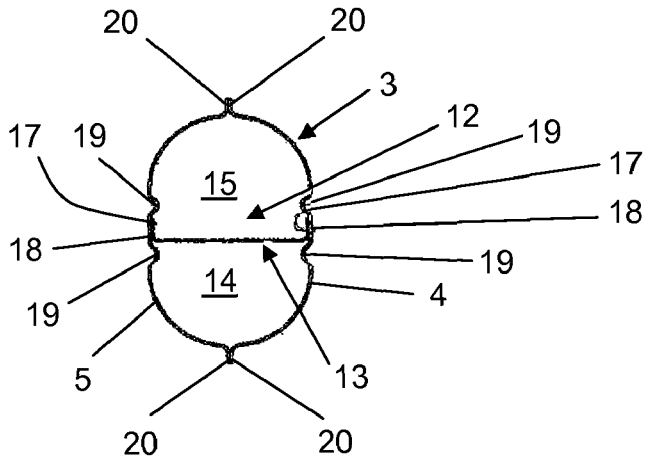
FIG. 5 is a simplified sectional view of the X-tube corresponding to section lines V in FIG. 2.
Figure 6:
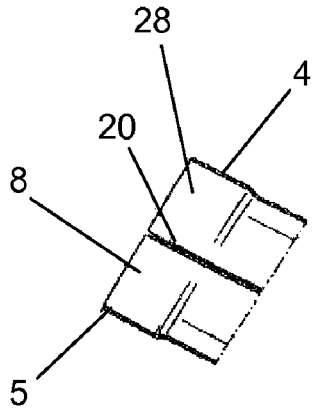
FIG. 6 is a sectional view of the X-tube corresponding to section lines VI in FIG. 2.
Figure 7:
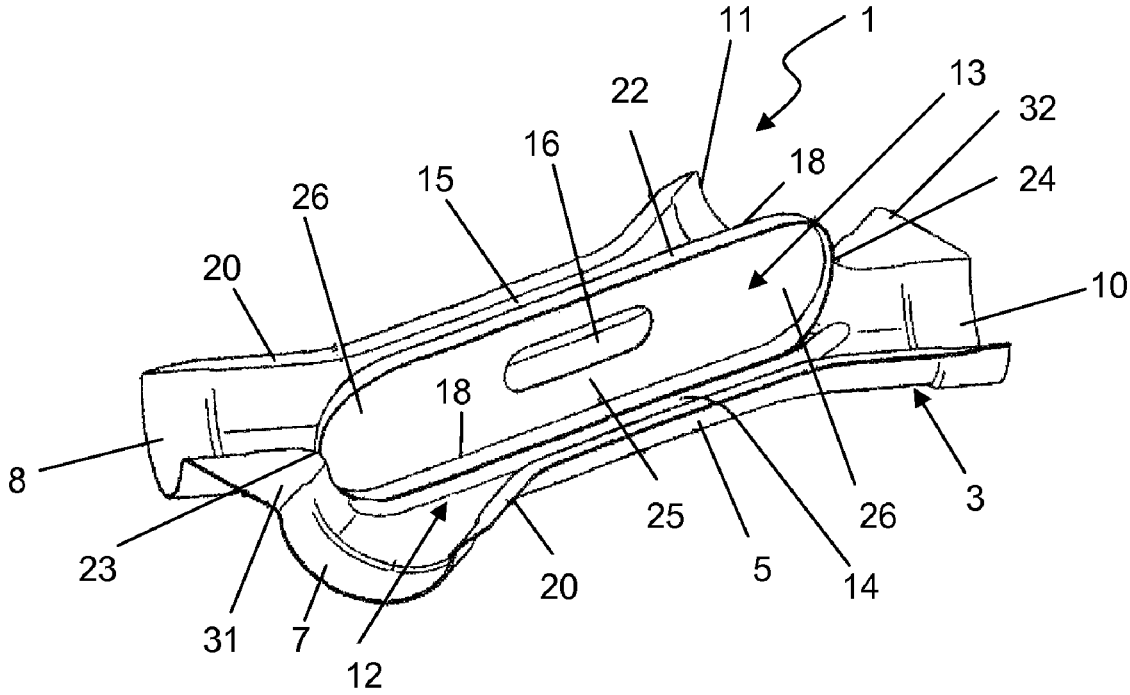
FIG. 7 is a perspective view of the X-tube with a half shell removed.

In the top view according to FIG. 2, the flow paths within the X-tube 1 have an X-shaped contour, which leads to the designation "X-tube" or "X-hose."

Corresponding to the preferred embodiment being shown here, bottom 13 may have a collar 22, which extends fully circumferentially on the edge, on a side that faces one of the ducts 14, 15, here the first duct 14. Furthermore, collar 22 projects from the rest of the bottom 13 or from the plane of bottom 13 towards the duct 14, 15, i.e., here the first duct 14. Corresponding to FIGS. 2, 7 and 8, collar 22 is fastened on the inlet side and on the outlet side in the preferred embodiment being shown here. This means that the height of collar 22, by which collar 22 projects from the rest of the bottom 13 or from the plane of bottom 13, is smaller on the inlet side and on the outlet side than in a middle section. In particular, the height of the collar decreases without steps and especially continuously from the middle section to an inlet end 23 of bottom 13 as well as to an outlet end 24 of bottom 13. This reduction in height takes place starting from both longitudinal ends 18 of bottom 13 and—as was mentioned above—preferably mirror symmetrically to the plane of separation of the half shells 4, 5.

In a projection oriented at right angles to its plane, bottom 13 preferably has an oval ground plan, which comprises a rectangular middle section 25 and two semicircular end sections 26. The flattened areas of collar 22 are preferably formed exclusively in the end sections 26. The only passage opening 16 is made congruent with bottom 13 in the example being shown and correspondingly also has an oval opening cross section.

Housing 3 comprises two inlet sections, namely, a first inlet section 27, which comprises the first inlet opening 7 and connects it to the first duct 14 in a communicating manner, and a second inlet section 28, which comprises the second inlet opening and connects it to the second duct 15 in a communicating manner. Furthermore, housing 3 has two outlet sections, namely, a first outlet section 29, which comprises the first outlet opening 10 and connects it to the first duct 14 in a communicating manner, and a second outlet section 30, which comprises the second outlet opening 11 and connects it to the second duct 15 in a communicating manner. The inlet sections 27, 28 and the outlet sections 29, 30 are formed by half on the half shells 4, 5. The half shells 4, 5 likewise form only one half of the openings 7, 8, 10, 11, which are completed to complete openings 7, 8, 10, 11 in the assembled housing 3 only.

On the inlet side 6 and on the outlet side 9 each, the half shells 4, 5 have a respective connecting web 31 and 32. On the whole, four such connecting webs are thus provided, namely, two inlet-side connecting webs 31 and two outlet-side connecting webs 32. The connecting webs 31, 32 are located outside the interior space 12. Two connecting webs 31, 32 each, namely, the two inlet-side connecting webs 31 and the two outlet-side connecting webs 32, are flatly in contact with one another, namely in the plane of separation. The two half shells 4, 5 are also fastened to one another in the area of these connecting webs 31, 32, for example, by means of a welded connection or by means of a soldered connection.

In the example being shown, the X-tube 1 comprises exactly three components, namely, the two half shells 4, 5 and bottom 13, and the two half shells 4, 5 may also be identical parts, so that only a total of two different components are needed to manufacture the X-tube 1.

Corresponding to FIG. 8, the exhaust system 2, by means of which exhaust gases of an internal combustion engine, which is not shown here and which may be arranged especially in a motor vehicle, can be removed, comprises two exhaust pipes, through which parallel flow is possible, namely, a first exhaust pipe 33 and a second exhaust pipe 34. The two exhaust pipes 33, 34 form a double-flow section of the exhaust system 2. Flow can take place through them in parallel and they are coupled with one another via the X-tube 1. An inlet section 35 of the first exhaust pipe 33 is connected for this to the first inlet opening 7 of the X-tube 1. An outlet section 36 of the first exhaust pipe 33 is connected to the first outlet opening 10 of the X-tube 1. An inlet section 37 of the second exhaust pipe 34 is connected to the second inlet opening 8. An outlet section 38 of the second exhaust pipe 34 is connected to the second outlet opening 11. The X-tube 1 makes possible an airborne sound-transmitting coupling of the two exhaust flows within the two exhaust pipes 33, 34 without generating a significant increase in pressure in the exhaust gas flows in the process.

While specific embodiments of the invention have been described in detail to illustrate the application of the principles of the invention, it will be understood that the invention may be embodied otherwise without departing from such principles.

What is claimed is:

1. An X-tube for an at least partly double-flow exhaust system of a motor vehicle internal combustion engine, the X-tube comprising:

a housing comprising two half shells providing two inlet openings on an inlet side and two outlet openings on an outlet side;

an interior space enclosed by said housing and to which said openings are connected in a communicating manner;

a bottom comprising a separate component in relation to the two half shells, said bottom dividing the interior space into two ducts, which are each connected to a respective one of said inlet openings and to a respective one of said outlet openings, each in a communicating manner, wherein said bottom is made permeable to airborne sound and connects said two ducts to one another in an airborne sound-transmitting manner.

2. An X-tube in accordance with claim 1, wherein said half shells each have, between said ducts, a mounting groove into which longitudinal ends of said bottom are inserted.

3. An X-tube in accordance with claim 2, wherein said half shells each have, between said ducts, two inwardly projecting longitudinal beads, which extend in parallel to one another and form the respective mounting grooves in the interior space.

4. An X-tube in accordance with claim 1, wherein the position of said bottom is fixed in said housing by bracing said bottom with said half shells or by a welded connection of said bottom to at least one of the half shells.

5. An X-tube in accordance with claim 1, wherein said bottom extends in a plane that extends in parallel to a principal directions of flow prevailing in said two ducts, said principal directions of flow being in parallel to each other, and said plane extends at right angles to a plane of separation, in which said half shells are attached to one another.

6. An X-tube in accordance with claim 1, wherein on a side facing one of said ducts, said bottom has a collar extending circumferentially on an edge and projecting from said duct.

7. An X-tube in accordance with claim 6, wherein said collar is flattened on the inlet side and on the outlet side.

8. An X-tube in accordance with claim 7, wherein said bottom has an oval shape with a rectangular middle section and two semicircular end sections.

9. An X-tube in accordance with claims 8, wherein the flattened areas are formed each exclusively in the end sections.

10. An X-tube in accordance with claim 1, wherein said bottom is mirror symmetrical in relation to a plane of separation, in which the half shells are attached to one another.

11. An X-tube in accordance with claim 1, wherein said two half shells are designed as identical parts.

12. An X-tube in accordance with claim 1, wherein:

said two inlet sections, which connect one of the inlet openings each to one of said ducts, are formed on said housing; and said two outlet sections, which connect one of the outlet openings each to one of said ducts are formed on said housing.

13. An X-tube in accordance with claim 1, wherein outside said interior space, said half shells, on the inlet side and on the outlet side, each have a connecting web which are flatly in contact with one another.

14. An exhaust system for a motor vehicle internal combustion engine, the system comprising: two exhaust pipes through which flow can take place in parallel; and an X-tube coupling said two exhaust pipes with one another, said X-tube comprising:

a housing comprising two half shells providing two inlet openings on an inlet side and two outlet openings on an outlet side;

an interior space enclosed by said housing and to which said openings are connected in a communicating manner;

a bottom comprising a separate component in relation to the two half shells, said bottom dividing the interior space into two ducts, which are each connected to a respective one of said inlet openings and to a respective one of said outlet openings, each in a communicating manner, wherein said bottom is made permeable to airborne sound and connects said two ducts to one another in an airborne sound-transmitting manner.

15. A system in accordance with claim 14, wherein said half shells each have, between the ducts, a mounting groove into which longitudinal ends of said bottom are inserted.

16. A system in accordance with claim 15, wherein the half shells each have, between the ducts, two inwardly projecting longitudinal beads, which extend in parallel to one another and form the respective mounting grooves in the interior space.

17. A system in accordance with claim 14, wherein said bottom extends in a plane that extends in parallel to a principal directions of flow prevailing in said two ducts, said principal directions of flow being in parallel to each other, and said plane extends at right angles to a plane of separation, in which said half shells are attached to one another.

18. A system in accordance with claim 14, wherein:

on a side facing one of said ducts, said bottom has a collar extending circumferentially on an edge and projecting from said duct said collar is flattened on the inlet side and on the outlet side;

said bottom has an oval shape with a rectangular middle section and two semicircular end sections; and the flattened areas are formed each exclusively in the end sections.

19. A system in accordance with claim 14, wherein said bottom is mirror symmetrical in relation to a plane of separation, in which the half shells are attached to one another; and said two half shells are designed as identical parts.

20. A system in accordance with claim 14, wherein:

said two inlet sections, which connect one of the inlet openings each to one of said ducts, are formed on said housing; and said two outlet sections, which connect one of the outlet openings each to one of said ducts are formed on said housing.

* * * * *